United States Patent [19]

Hayes-Pankhurst et al.

[11] Patent Number: 4,634,818

[45] Date of Patent: Jan. 6, 1987

[54] SWITCHES AND KEYBOARDS

[75] Inventors: Richard P. Hayes-Pankhurst; Brian D. Smith, both of London, United Kingdom

[73] Assignee: NPM International, London, England

[21] Appl. No.: 783,927

[22] PCT Filed: Feb. 4, 1985

[86] PCT No.: PCT/GB85/00049

§ 371 Date: Sep. 26, 1985

§ 102(e) Date: Sep. 26, 1985

[87] PCT Pub. No.: WO85/03595

PCT Pub. Date: Aug. 15, 1985

[30] Foreign Application Priority Data

Feb. 3, 1984 [GB] United Kingdom ..... 8402974

[51] Int. Cl.[4] ..... H01H 13/70

[52] U.S. Cl. ..... 200/5 A; 200/159 B

[58] Field of Search ..... 200/5 A, 86 R, 159 B, 200/314, 317, 329, 340, 275

[56] References Cited

U.S. PATENT DOCUMENTS

| | | | |
|---|---|---|---|
| 3,054,879 | 9/1962 | Soreng | 200/159 B |
| 3,699,294 | 10/1972 | Sudduth | 200/86 R X |
| 3,728,509 | 4/1973 | Shimojo | 200/159 B |
| 3,760,137 | 9/1973 | Shimojo et al. | 200/263 |
| 3,761,944 | 9/1973 | Shimojo | 200/159 B X |
| 3,932,722 | 1/1976 | Obata et al. | 200/340 |
| 4,081,631 | 3/1978 | Feder | 200/340 X |
| 4,127,758 | 11/1978 | Lowthorp | 200/159 B X |
| 4,343,975 | 8/1982 | Sado | 200/314 |
| 4,378,478 | 3/1983 | Deeg | 200/340 X |
| 4,421,966 | 12/1983 | Pounds | 200/309 |
| 4,491,702 | 1/1985 | Kato | 200/159 B X |

FOREIGN PATENT DOCUMENTS

| | | |
|---|---|---|
| 2540011 | 3/1976 | Fed. Rep. of Germany . |
| 3218404 | 11/1983 | Fed. Rep. of Germany . |
| 871287 | 4/1942 | France . |
| 123184 | 10/1984 | France . |
| 2082840A | 3/1982 | United Kingdom . |

OTHER PUBLICATIONS

Electronic Design; Ed Connolly; "Focus on Membrane Switches: Simple, Colorful, and Reliable"; vol. 30, Sep., 1982, pp. 183–192.

*Primary Examiner*—J. R. Scott

*Attorney, Agent, or Firm*—Shoemaker and Mattare, Ltd.

[57] ABSTRACT

A low profile switch or keypad has one or more touch pads (14) formed integrally with and raised from a surrounding membrane or key mat (15) of elastomeric material by a wall (30) of resiliently deformable material of thickness and angle relative to the mat (15) so that the wall (30) can flex under finger pressure on the or each pad (14) without deflecting the surrounding membrane. The underside of each pad (14) is formed with a convex contact pad (29) dimensioned in relation to the pad diameter and travel and the length of wall (30) so that the pad (29) makes surface to surface contact with conductors (12), (13) of an underlying circuit board (10). The mat (15) is held in tension to the board (10) fits. The keyboard uses only two interfitting parts and needs no bezel but provides a tactile response to key depression.

10 Claims, 3 Drawing Figures

2
2
15
9
6
3
14
30
29
13
12
11
10
16
17
24
23
26

SWITCHES AND KEYBOARDS

FIELD OF THE INVENTION

The present invention relates to a switch for an electrical or electronic device that may be incorporated into a keypad for the input of data to a digital device.

BACKGROUND TO THE INVENTION

The cost of digital data processing circuitry has fallen spectacularly since computers began to be mass produced and this cost reduction has exerted a corresponding downward pressure on the cost of peripherals such as keyboards.

A conventional typewriter-type keyboard has moving keys controlling individual switches, but is relatively expensive to make. A membrane keyboard such as has been fitted to the Sinclair 2X 81 microcomputer enables substantial cost reductions to be made but provides no tactile feedback to the user as to whether depression of a key has provided a registrable signal. In other low cost computers such as that fitted to the Sinclair Spectrum the keys are formed integrally with a moulded rubber membrane. But the rubber sheet has to be overlaid by an apertured cover plate or bezel and the keys are used to close contacts in a membrane-type grid supported by a backing plate which is still relatively complex. Keyboards using silicone rubber sheets bearing conductive pads resiliently supported in contact elements formed in the sheets that directly close circuits between conductors on an underlying circuit board are sold by Maag Technic AG and provide a snap action and hence a degree of user tactile feedback. But again the silicone sheet is concealed within the keyboard structure and is intended to be used with separate typewriter- or calculator-style keys working in a bezel.

SUMMARY OF THE INVENTION

It is an object of the invention to provide a switch for a keyboard or other device of simplified construction using essentially only two interfitting parts but which nevertheless is of attractive appearance and provides a tactile response to effective key depression.

Broadly stated the invention provides an electrical switch comprising a contact surface and a combined cover and membrane of resiliently deformable material positioned against the contact surface so that an otherwise unsupported integral touch pad raised from the surrounding membrane by a thin angled wall flexes under finger pressure through an over-centre position to press its convex underside against the contact surface to close the switch, wherein the membrane surrounding the wall is at least 1.5 mm thick and the wall length and underside curvature are selected in relation to the touch pad size and travel so that the underside makes face to face contact with the contact layer over the full range of angles to which the touch pad tilts when the finger pressure is asymmetric.

The invention further provides a keyboard comprising a contact surface and a combined cover and membrane of resiliently deformable material positioned against the contact surface so that otherwise unsupported integral touch pads disposed in an array and each raised from the surrounding membrane by a thin angled wall flex through an over-centre position to press respective convex undersides against the contact surfaces to close respective switches, the membrane between the touch pads being at least 1.5 mm thick and the wall length and underside curvature being selected in relation to the touch pad size and travel so that the underside makes face to face contact with the contact layer over the full range of angles to which the touch pad tilts when the finger pressure is asymmetric.

German OLS. No. 3218404 describes a key mat with raised keys connected to the mat by a hinge but no attention has been paid to the possibility that pressure on one key might affect other keys or disturb the flatness of the surrounding membrane. The invention therefore further provides a low profile switch or keypad assembly having one or more touch pads formed integrally with and raised from a surrounding membrane of resiliently deformable material by a wall of a thickness and angle relative to the membrane enabling the wall to flex under finger pressure on the or each pad without deflecting the surrounding membrane.

An embodiment of the invention will now be described by way of example only with reference to the accompanying drawings, in which:

DETAILED DESCRIPTION OF PREFERRED EMBODIMENT

Figure 1:
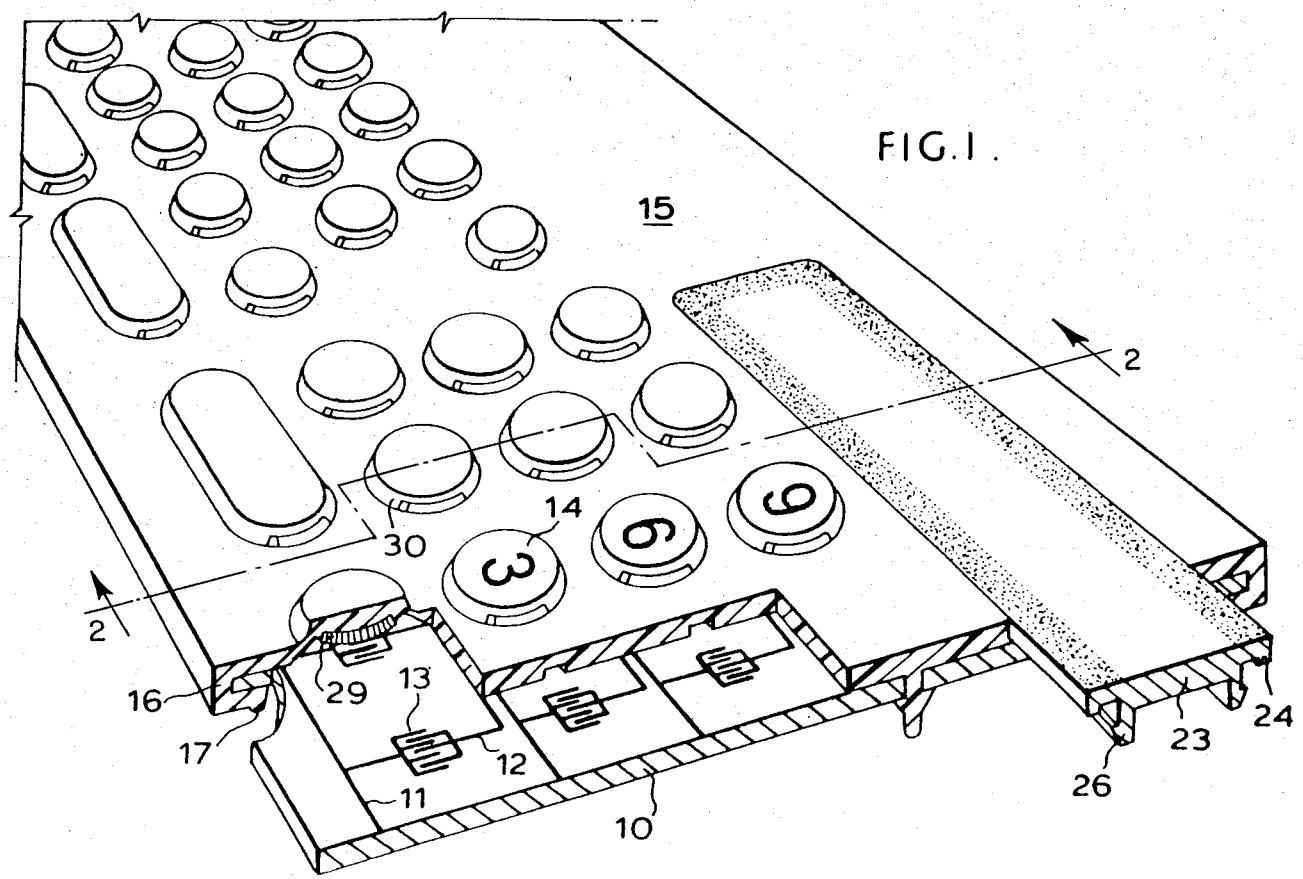
FIG. 1 is a perspective view of a key mat and keyboard PCB according to the invention.
Figure 2:
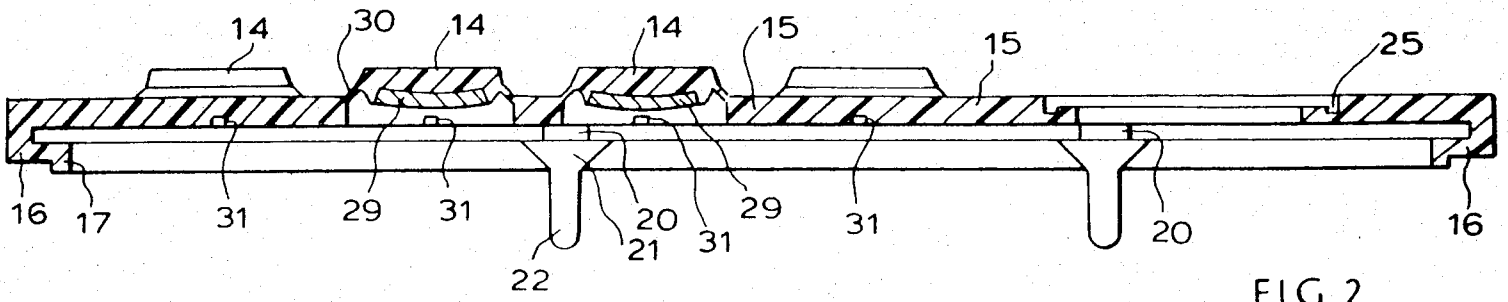
FIG. 2 is a section of the key mat on the line 2—2 of FIG. 1.

In FIG. 1 a printed circuit board 10 for a keyboard according to the invention has on its top face an array of conductors including row conductors 11 and column conductors 12 that define a matrix within which there are contact areas 13 corresponding to each key 14 in an overlying key mat 15. It will be noted that each contact area 13 comprises an interlaced array of conductive fingers (in this instance a 3 pronged fork entering a four pronged receptacle).

The purpose of this interleaved array is to provide an area which is comparable to that of the overlying key 14 within which contact may be made to signal that the key has been depressed.

The key mat 15 is a moulding in an elastomeric material such as silicon rubber or a rubber-modified polyurethane that when untensioned is of slightly lesser width and length than the circuit board 10. It has an integrally moulded peripheral lip 16 that has at its extremity a depending rim 17. The lip 16 can be engaged with the edges of the board 10 to retain the mat 15 in a predetermined location thereon with the mat 15 in tension both longitudinally and transversely. The advantage of this arrangement is that moulding tolerances in the mat 15 are substantially cancelled out when the mat 15 is fitted to the board 10 and each key 14 overlies the respective contact area 13 to a sufficient degree of accuracy to be serviceable. Furthermore the rim 17 is stretched to accurate predetermined dimensions so that it will locate properly in a recess in a chassis member to which the keyboard is to be secured. The rigidity of the PCB 10 should be such that the keyboard assembly is self-supporting and does not require external reinforcement and the keys 14 are maintained in stable positions without the need for an alignment bezel to be present as in conventional calculators and in membrane-type keyboards such as that of the Sinclair Spectrum.

Depending upon the overall dimensions of the keyboard it may be desirable to provide location and retaining means at intermediate positions widthwise and lengthwise thereof. Accordingly the board 10 is provided at appropriate positions with a pattern of location points in the form of through holes and the key mat 15 has a complementary pattern of locating studs. Each stud comprises a shank 20 that fits into the respective through hole, a retaining head or mushroom 21 and a depending finger 22 by which the head 21 can be pulled through the through hole.

The board 10 and mat 15 may be apertured to accommodate a window 23 for a display device such as a liquid crystal or LED display. The window 23 preferably has a rim 24 that engages in a recess 25 in the mat 15 to maintain the mat 15 flat on the board 10 notwithstanding the tension therein. It has fingers 26 that extend through the aperture in board 10 and mat 15 and locate on the underside of the board 10. It will be appreciated that in the present arrangement the exposed face of the keyboard is a continuous sheet of elastomer interrupted only by the non-moving windows about which there is an effective seal so that the assembly is protected from the ingress of moisture and dirt. Between the keys the exposed face of the membrane is pulled smooth by the slight tension therein and it should be at least 1.5 mm thick so that soldered component leads in the top face of board 10 or other protuberances can be concealed in recesses let into the lower face of the mat 15, as can air channels (described below) between the keys. If the dimensions of the window 23 exceed the dimensions of the device to be displayed therein there may be an area of the mat 15 that is relieved to underlie the window 23 and may carry information in the form of raised lettering or printed areas that are formed at the time of moulding. Or a pre-printed paper label can be retained in the relieved area. Furthermore the keys 14 may have printed or moulded-in legends and legends such as a manufacturer's logo may be moulded into blank areas of the mat 15. It will be appreciated therefore that a keyboard having any number of keys and the appropriate windows together with other indicia may be formed at a single moulding operation.

As is apparent from the foregoing the keys are operated by depressing buttons 14 that have on their undersides conductive pads 29 that when brought into contact with the contact areas 13 make a circuit between at least one pair of the interlaced contact fingers, so that a state corresponding to the depressed key is caused to exist in the row and column conductors 12, 13. A conductive pad 29 e.g. of graphite filled rubber that is somewhat harder than the elastomer of the pad 15 is provided as a disc that is inserted into the mould for the mat 15 and is moulded into the underside of each key 14. Each key 14 is preferably of circular or other non-angular shape, has substantially the thickness of the pad 15 and stands slightly proud as shown. It is joined to the body of the pad 15 by means of a wall 30 of thinner material which when viewed in section is directed at approximately 45° to the body of the pad 15. Accordingly as the key 14 is depressed the wall 30 exhibits an over-centre action such that depression of the key beyond its mid travel will with high probability result in the pad 29 contacting the area 13. The thickness of the membrane 30 is selected to give the desired tactile feedback to the keyboard operator, and the length thereof is selected in accordance with the intended travel of each key. The shape of the key 14 and membrane 30 is selected to avoid stress concentrations resulting in fatigue. The underside of the pad 29 is convex with a large radius of curvature that is also appropriate to the key travel and size so that it will touch the contact area 13 tangentially (i.e. surface to surface and not edge to surface) irrespective of whether or not the key 14 loses its proper attitude when it is depressed. Therefore the keyboard operator can strike the key off-centre and still make an effective contact, the substantial contact area of the conductive pad cooperating to achieve this result. Furthermore it has been found that the material of the key 14 is less likely to intrude onto the working face of the pad 29 during the moulding process if the pad 29 is convex as shown, so that the reject rate is reduced. Air grooves 31 let into the lower face of the mat 15 interconnect the several keys 14 to permit the key travel to take place.

Figure 3:
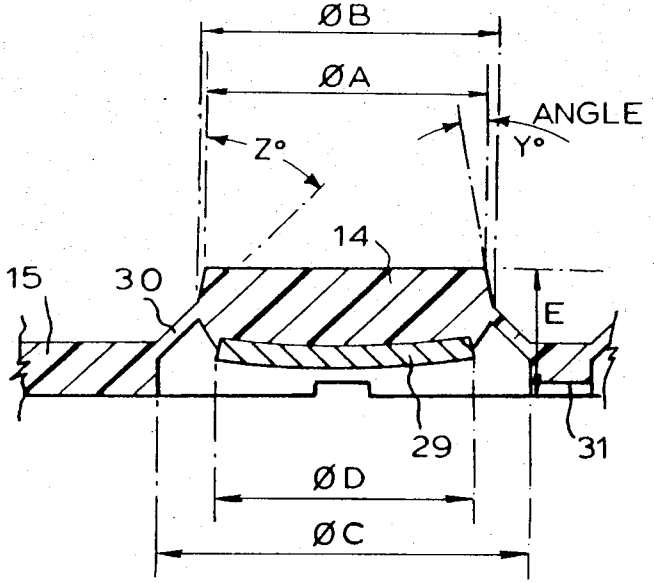
FIG. 3 is an enlarged fragmentary view of the key mat that is sectioned in the region of a single key.

In FIG. 3 the functional relationships between the various parts of an individual switch are apparent in a practical example. The key mat 15 has a ground portion 2.25 mm thick in which are set air passages 31 that are 0.5 mm high. The touch pad top diameter $\phi A$ is in this instance 10 mm and it is tapered to a rim outside diameter $\phi B$ of 11 mm. The wall 30 is of length 1.4 mm so that the base diameter $\phi C$ of the cavity underlying the touch pad 14 is 13 mm. The diameter $\phi D$ of the conductive pad 29 under the key 14 is given by:

$$\phi D = \phi C / 1.426$$

and in this instance is 9.1 mm, the relation between $\phi D$ and $\phi C$ having been empirically determined. The convex surface of the pad 29 has a radius of curvature ROC given by:

$$ROC = 2.6\ \phi C$$

and in the example given is 34 mm. The key 14 and moulding are 3.24 mm deep and the overall key height E is given by:

$$E = 3.24 + 1.51\ \phi C / \phi D$$

and is 4.75 mm. The travel between the pad 29 and the underlying conductor is about 0.5 mm. The angle Y between the top sidewall of each key 14 and a normal to the mat 15 is a small acute angle. The angle Z between the straight wall 30 and a normal to the mat 15 is about 45° as stated above.

It will be appreciated that the present construction is readily adaptable to making keyboards of a variety of shapes, key numbers and key positions, can incorporate buttons of different tactility so that eg. the numeric keys are stiffer than the alphabetical keys. Various modifications may be made to the described embodiment without departing from the invention, the scope of which is defined in the appended claims. For example, the PCB 10 could be replaced by a membrane switch over an underlying support of e.g. aluminium sheet. LED's could be provided in the PCB 10 and a mat 15 of transluscent material could be used, thereby providing the possibility of back-lighting the wall 30 around each key.

We claim:

1. A keypad consisting of a combined cover and membrane (15) of resiliently deformable material and a substrate (10) bearing open-circuit conductors (12, 13) against which substrate (10) of the combined cover and membrane (15) is positioned with otherwise unsupported integral touch pads (14) disposed in an array and each raised from the surrounding membrane (15) by an angled wall (30) arranged so that finger pressure on any touch pad (14) depresses it until a conductive surface (29) on the underside of the touch pad (14) contacts the substrate (10) and makes the circuit between the conductors (12, 13), characterized in that:

(a) each touch pad (14) and the surrounding membrane (15) are relatively thick and the wall (30) is relatively thin, and the thickness and angle of the wall are such that each touch pad (14) can be depressed without deflecting the surrounding membrane (15);

(b) the length of each wall (30) between the membrane and the associated touch pad is relatively small in comparison with the width of the associated touch pad (14) and each wall (30) is arranged to give way through an over-center position to give a tactile sensation; and (c) each conductive surface (29) occupies most of the width of the associated touch pad (14), the conductive surface (20) being convex with a radius of curvature selected in relation to the length and angle of the wall (30) and the touch pad (14) size ($\phi$B) and travel so that the conductive surface (29) makes face to face contact with the substrate (10) over the full range of angles to which the touch pad (14) tilts when the finger pressure is asymmetric.

2. A keypad according to claim 1, wherein the ratio of the width of the wall (30) to the width ($\phi$B) of the touch pad (14) is about 0.1, ratio of the width of the conductive surface (29) to the width ($\phi$B) of the touch pad (14) is about 0.8, the radius of curvature of the convex conductive surface (29) is about 2.6 $\phi$C wherein $\phi$C is the width between the locations where opposed parts of wall (30) join the membrane (15) and the conductive surface (29) is a moulded-in disc of elastomer that is a harder material than the material of the membrane (15) and touch pads (14).

3. A keypad according to any preceding claim, wherein the membrane (15) is moulded slightly under the size of the substrate (10) and has a peripheral lip (16) into which edges of the substrate (10) locate to maintain the membrane (15) in position against the substrate (10) and to tension the membrane (15).

4. A keypad according to claim 3, wherein retaining studs (20, 21) project from the underside of the membrane (15) and located in through holes in the substrate (10).

5. A keypad according to claim 1 or 2, wherein the substrate (10) is a printed circuit board formed with an array of interdigitated contact fingers under each touch pad (14).

6. A keypad according to claim 1 or 2, wherein the visible face of each touch pad (14) is individually colored or marked for identification.

7. A keypad according to claim 1 or 2, wherein the membrane (15) is of transluscent material.

8. A two component keypad consisting of a combined cover and membrane (15) of resiliently deformable material and a substrate (10) bearing open-circuit conductors (12, 13) against which substrate (10) of the combined cover and membrane (15) is positioned with otherwise unsupported integral touch pads (14) disposed in an array and each raised from the surrounding membrane (15) by an angled wall (30) arranged so that finger pressure on any touch pad (14) depresses it to contact the substrate (10) and makes the circuit between the conductors (12, 13), characterized in that:

(a) each touch pad (14) and the surrounding membrane (15) are relatively thick and the wall (30) is relatively thin and the thickness and angle of the wall are such that each touch pad (14) can be depressed without deflecting the surrounding membrane (15);

(b) the length of each wall (30) between the membrane and the associated touch pad is relatively small in comparison with the width of the associated touch pad (14);

(c) the gap between the substrate (10) and the undersurface (29) of the touch pad is no greater than the thickness of the surrounding membrane (15); and (d) the dimensions and angle of each wall (30) relative to the touch pad (14) and the membrane (15) are such that irrespective of the angle to which the touch pad (14) tilts the wall (30) gives way through an over-center position to give a tactile sensation.

9. A keypad consisting of a circuit-bearing substrate and a membrane of resiliently deformable material having a plurality of raised dome keys moulded therein each defined by a dome wall and a touch pad at the top of the wall, the gap between the substrate and a conductive undersurface of each integral touch pad being no greater than the thickness of the membrane, and the thickness and angle of each dome wall relative to the touch pad and the membrane being such that irrespective of the angle to which the touch pad tilts the wall gives way to give a change in tactile sensation immediately before contact is made.

10. A keypad as claimed in claim 9, wherein the membrane and touch pad are of substantially the same thickness and the conductive undersurface is convex and disposed no higher than the line of the top surface of the membrane.

* * * * *